US008320598B2

(12) United States Patent
Rouvala et al.

(10) Patent No.: US 8,320,598 B2
(45) Date of Patent: Nov. 27, 2012

(54) APPARATUS AND METHOD

(75) Inventors: Markku Rouvala, Helsinki (FI); Tim Mellow, Farnham (GB); Pritesh Hiralal, Cambridge (GB); Haolan Wang, Cambridge (GB); Gehan Amaratunga, Cambridge (GB)

(73) Assignee: Nokia Corporation, Espoo (FI)

( * ) Notice: Subject to any disclaimer, the term of this patent is extended or adjusted under 35 U.S.C. 154(b) by 273 days.

(21) Appl. No.: 12/605,644

(22) Filed: Oct. 26, 2009

(65) Prior Publication Data

US 2010/0329494 A1 Dec. 30, 2010

Related U.S. Application Data

(63) Continuation-in-part of application No. 12/459,347, filed on Jun. 30, 2009.

(51) Int. Cl.
*H04R 25/00* (2006.01)

(52) U.S. Cl. ..... 381/345; 381/353; 381/354

(58) Field of Classification Search ..... 381/332, 381/337, 338, 345, 346, 349, 353, 354, 386, 381/189; 181/146, 149, 151, 156, 160, 199
See application file for complete search history.

(56) References Cited

U.S. PATENT DOCUMENTS

| | | | | |
|---|---|---|---|---|
| 4,101,736 | A * | 7/1978 | Czerwinski | 381/332 |
| 4,657,108 | A * | 4/1987 | Ward | 181/151 |
| 7,463,747 | B2 * | 12/2008 | Kuze et al. | 381/345 |
| 2006/0116284 | A1 | 6/2006 | Pak et al. | 502/180 |
| 2007/0048209 | A1 | 3/2007 | Smalley et al. | 423/447.1 |
| 2007/0147645 | A1 | 6/2007 | Kuze et al. | 381/337 |
| 2008/0049949 | A1 | 2/2008 | Snider et al. | 381/86 |
| 2008/0187154 | A1 | 8/2008 | Martin | 381/174 |

FOREIGN PATENT DOCUMENTS

| | | | |
|---|---|---|---|
| EP | 1 868 409 | A1 | 12/2007 |
| EP | 2 003 924 | A1 | 12/2008 |
| JP | 2003225561 | A | 8/2003 |
| JP | 2005021829 | A | 1/2005 |
| JP | 2006101031 | A | 4/2006 |

OTHER PUBLICATIONS

"The Current Status of Carbon Nanotube and Nanofiber Production", Nanotechnologies in Russia, vol. 3, Nos. 9-10 (2008) (pp. 575-580).

* cited by examiner

*Primary Examiner* — Huyen D Le
(74) *Attorney, Agent, or Firm* — Harrington & Smith

(57) ABSTRACT

An apparatus and method of providing an apparatus, the apparatus including: a loudspeaker configured to convert an electrical input signal into an acoustic output signal; and carbon nanohorn material wherein the carbon nanohorn material is positioned so as to be exposed to the acoustic output signal.

18 Claims, 4 Drawing Sheets

APPARATUS AND METHOD

CROSS REFERENCE TO RELATED APPLICATION

This application is a continuation-in-part patent application, which claims priority under 35 U.S.C. §120 from U.S. patent application Ser. No. 12,459,347, filed Jun. 30, 2009, the entire contents of which is hereby incorporated by reference in its entirety.

FIELD OF THE INVENTION

Embodiments of the present invention relate to an apparatus and method. In particular, they relate to an apparatus and method where the apparatus comprises a loudspeaker.

BACKGROUND TO THE INVENTION

Apparatus comprising loudspeakers, which are configured to convert an electrical input signal to an acoustic output signal, are well known.

Such loudspeakers typically comprise a driver which is configured to drive the oscillation of a diaphragm to generate a pressure wave. The loudspeakers are often mounted within an acoustic cavity. An acoustic cavity prevents the pressure wave which is generated by the back of the diaphragm from destructively interfering with the pressure wave from the front of the diaphragm.

The volume of the acoustic cavity defines the resonant frequency of the loudspeaker. Acoustic cavities with a large effective volume have a lower resonant frequency than acoustic cavities with a small effective volume. The response of the loudspeaker decreases below the resonant frequency of the loudspeaker. This means that if the acoustic cavity has a small volume the loudspeaker may not be able to produce low frequency acoustic signals very well.

In some apparatus the volume available for an acoustic cavity is limited. For example in a handheld device such as a telephone or a personal music player only a small volume may be available for the acoustic cavity. This may result in poor sound quality for low frequency acoustic signals.

BRIEF DESCRIPTION OF VARIOUS EMBODIMENTS OF THE INVENTION

According to various, but not necessarily all, embodiments of the invention there is provided an apparatus comprising: a loudspeaker configured to convert an electrical input signal into an acoustic output signal; and carbon nanohorn material wherein the carbon nanohorn material is positioned so as to be exposed to the acoustic output signal.

The carbon nanohorn material comprises carbon nanohorns. A carbon nanohorn is a nano-scale tube of carbon which differs from a carbon nano-tube in that it has a horn shape rather than a cylindrical shape. For example, the cross sectional area of a carbon nanotube is constant along the axis of the nanotube whereas the cross sectional area of a carbon nanohorn may vary along the axis of the carbon nanohorn. The cross sectional area of the carbon nanohorn may decrease along the axis of the nanohorn. The carbon nanohorns typically have a diameter of 2-3 nm at the tip and a length of between 20-50 nm. However it may be possible for the nanohorns to be different sizes. The shape of the carbon nanohorn results in the carbon nanohorns having a larger surface strain than a carbon nanotube. The Carbon nanohorns may form aggregates which have a very large surface area. The aggregates formed may have a diameter between 30-100 nm. The aggregates formed may be substantially spherical.

In some embodiments of the invention the carbon nanohorn material may adsorb air molecules in response to an increase in pressure caused by the acoustic output signal and so reduce the resonant frequency of the loudspeaker.

In some embodiments of the invention the loudspeaker may be positioned within an acoustic cavity and the carbon nanohorn material may be positioned within the acoustic cavity.

In some embodiments of the invention the acoustic cavity may comprise walls which may be configured to enable the carbon nanohorn material to be adhered to the apparatus.

In some embodiments of the invention the carbon nanohorn material may comprise a powder. The apparatus may comprise a seal configured to prevent leakage of the carbon nanohorn material.

In some embodiments of the invention the carbon nanohorn material may be mixed with a polymer to enable the carbon nanohorn material to be adhered to the apparatus.

In some embodiments of the invention the carbon nanohorn material may be bound to a substrate. The substrate may be bent to enable the substrate to fit within the apparatus. The substrate may comprise paper or aluminium foil or a carbon nanotube mat.

The apparatus may be for producing an acoustic output signal for a user to hear. For example the apparatus may be a telephone or a personal music player.

According to various, but not necessarily all, embodiments of the invention there is provided a method comprising: configuring a loudspeaker to convert an electrical input signal into an acoustic output signal; and positioning carbon nanohorn material so as to be exposed to the acoustic output signal.

In some embodiments of the invention the carbon nanohorn material may be positioned so that the carbon nanohorn material may adsorb air molecules in response to an increase in pressure caused by the acoustic output signal and so reduce the resonant frequency of the loudspeaker.

In some embodiments of the invention the method may comprise positioning the loudspeaker within an acoustic cavity and positioning the carbon nanohorn material within the acoustic cavity.

In some embodiments of the invention the method may comprise adhering the carbon nanohorn material to walls of the acoustic cavity.

In some embodiments of the invention the carbon nanohorn material may comprise a powder. The method may comprise sealing the carbon nanohorn material in position to prevent leakage of the carbon nanohorn material.

In some embodiments of the invention the method may comprise mixing the carbon nanohorn material with a polymer to enable the carbon nanohorn material to be adhered in position.

In some embodiments of the invention the method may comprise binding the carbon nanohorn material to a substrate. The method may also comprise bending the substrate to enable the substrate to fit within an apparatus. The substrate may comprise paper or aluminium foil or a carbon nanotube mat.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

The Figures illustrate an apparatus 1 comprising: a loudspeaker 5 configured to convert an electrical input signal into an acoustic output signal; and carbon nanohorn material 13 wherein the carbon nanohorn material 13 is positioned so as to be exposed to the acoustic output signal.

In the following description, unless expressly stated otherwise, the words "connect" and "couple" and their derivatives mean operationally connected or operationally coupled. It is to be appreciated that any number or combination of intervening components can exist including no intervening components.

Figure 1:
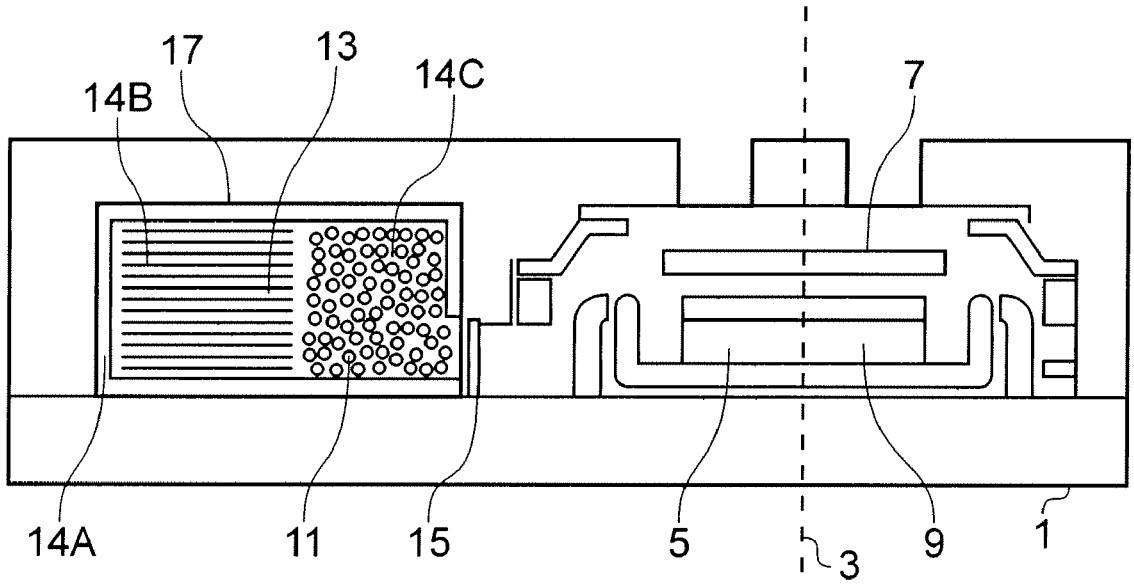
FIG. 1 schematically illustrates a cross section of an apparatus according to a first embodiment of the invention.

FIG. 1 schematically illustrates a cross section of an apparatus 1 according to a first embodiment of the invention. The apparatus 1 comprises a loudspeaker 5 and carbon nanohorn material 13. Only features referred to in the following description are illustrated in FIG. 1. It should, however, be understood that the apparatus 1 may comprise additional features that are not illustrated.

The loudspeaker 5 may be any means which enables an electrical input signal to be converted into an acoustic output signal. The acoustic output signal comprises a pressure wave. The acoustic output signal may be audible to a user of the apparatus 1.

In the illustrated embodiment the loudspeaker 5 comprises a driver 9 and a diaphragm 7. The driver 9 is mounted within the apparatus 1 so that it can move backwards and forwards along an axis indicated by the dashed line 3. The driver 9 is also configured to receive an electrical input signal. The electrical input signal controls the movement of the driver 9 along the axis 3 and so controls the acoustic output signal generated by the loudspeaker 5.

The diaphragm 7 is coupled to the driver 9 so that when the driver 9 moves, the diaphragm 7 also moves. The movement of the diaphragm 7 creates a pressure wave which provides the acoustic output signal which is audible to a user of the apparatus 1. The movement of the diaphragm 7 creates a pressure wave both in front of and behind the diaphragm 7.

In the embodiment illustrated in FIG. 1 the apparatus 1 also comprises an acoustic cavity 11. The acoustic cavity 11 is an enclosed volume within the apparatus 1. The acoustic cavity 11 may comprise walls 17 which define the volume of the acoustic cavity 11. In some embodiments of the invention a gas such as air may be provided within the acoustic cavity 11. In some embodiments of the invention a solid material such as carbon nanohorn material 13 may also be provided within the acoustic cavity 11.

The acoustic cavity 11 may be completely sealed, so that any gas within the acoustic cavity 11 cannot escape. In some embodiments of the invention the acoustic cavity may be only partially sealed so that the pressure within the acoustic cavity 11 may equalize with pressure in the surrounding environment when a pressure change occurs in the surrounding environment. A pressure change may occur in the surrounding environment, for example, as a result of changes in temperature or atmospheric weather conditions.

The acoustic cavity 11 is positioned so that a movement of the driver 9 causes a pressure change within the acoustic cavity 11. The acoustic cavity 11 may be positioned adjacent to the loudspeaker 5 as illustrated in FIG. 1. In other embodiments of the invention the acoustic cavity 11 may be positioned behind the loudspeaker 5.

The acoustic cavity 11 may be any suitable size or shape. The size or shape of the acoustic cavity 11 may be determined by external factors. For example in some apparatus 1 such as hand held apparatus the space within the housing of the apparatus 1 which is available for a loudspeaker 5 and acoustic cavity may be limited and this may place a restriction on the size of the acoustic cavity 11.

The acoustic cavity 11 prevents the pressure wave from the back of the diaphragm 7 from interfering destructively with the pressure waves from the front of the diaphragm 7. The dimensions of the acoustic cavity 11 may determine the frequencies for which the acoustic cavity 11 provides the best response.

The air surrounding the diaphragm 7 acts as a spring which acts to push the driver 9 and the diaphragm 7 toward their equilibrium position in which the pressure is the same on either side of the diaphragm 7. When the driver 9 moves inwards into the acoustic cavity 11 this increases the pressure within the acoustic cavity 11 and creates a pressure difference between the air within the acoustic cavity 11 and the air outside. This increase in pressure acts to push the diaphragm 7 outwards towards the equilibrium position and so creates a resistance to further movement inwards. Similarly, when the driver 9 moves outwards this decreases the pressure within the acoustic cavity 11. The pressure difference created acts to push the diaphragm 7 inwards towards the equilibrium position. Therefore the air within acoustic cavity 11 acts as a spring. The stiffness of the spring is determined by the volume of the acoustic cavity 11. The stiffness of the spring also determines the resonant frequency of the loudspeaker 5 and consequently the low frequency response of the loudspeaker 5.

The apparatus 1 also comprises carbon nanohorn material 13. The carbon nanohorn material 13 is positioned within the apparatus 1 so that it is exposed to the acoustic output signal created by the loudspeaker 5. That is, the pressure wave which is created by the loudspeaker is incident on the carbon nanohorn material 13 so that there is a variation in the pressure at the surface of the carbon nanohorn material 13. In the illustrated embodiment carbon nanohorn material 13 is provided within the acoustic cavity 11.

In the embodiments illustrated in FIG. 1 the carbon nanohorn material 13 is provided in a plurality of different configurations.

In the first configuration 14A the carbon nanohorn material 13 is adhered to the walls of the acoustic cavity 11. The carbon nanohorn material 13 may be adhered to the wall of the acoustic cavity 13 using any suitable means. For example in some embodiments of the invention the carbon nanohorn material 13 may be mixed with a polymer material which enables the carbon nanohorn material 13 to bind to the walls of the acoustic cavity 11.

In other embodiments of the invention the carbon nanohorn material 13 may be adhered to the walls of the acoustic cavity 11 by using a drop casting technique. For example, the carbon nanohorn material 13 may be dissolved in a liquid or in nitrogen to form a carbon nanohorn solution. The solution may then be applied to the walls of the acoustic cavity 11. The liquid or the nitrogen then evaporates from the solution leaving the carbon nanohorn material 13 behind. The evaporation of the liquid or nitrogen creates a van der waals forces between the carbon nanohorn material 13 and the walls of the acoustic cavity 11. The van der waals forces bind the carbon nanohorn material 13 to the walls of the acoustic cavity and prevent leakage of the carbon nanohorn material 13 when the apparatus 1 is in use. In some embodiments of the invention the apparatus 1 may be heated to enable the liquid or nitrogen to evaporate.

In the second configuration 14B the carbon nanohorn material 13 is adhered to a substrate. The substrate is then positioned within the acoustic cavity 11. The substrate may comprise any suitable material, for example in some embodiments of the invention the substrate may comprise paper. The use of paper provides the advantage that it is has a low cost and is easily folded or bent into a shape to fit into the acoustic cavity 11. The paper may also be cut into a suitable size or shape to enable the substrate to be positioned within the acoustic cavity 11.

In some embodiments of the invention the substrate may comprise a metal foil such as aluminum foil. The metallic foil may be thin enough to enable the foil to be easily folded or bent into a suitable size and shape to fit into the acoustic cavity 11.

In other embodiments of the invention the substrate may comprise a carbon nanotube mat. The carbon nanotube mat may also be bent or folded into any suitable shape to fit into the acoustic cavity 11. The carbon nanotube mat provides a stable substrate to which the carbon nanohorn material 13 may be adhered.

The carbon nanotube mat may comprise a plurality of carbon nanotubes which are entangled together to form a mat. The carbon nanotubes may be single walled or multi-walled. The carbon nanotube mat may be formed by vacuum filtration of a carbon nanotube solution. Alternatively the carbon nanotube mat may be formed by growing carbon nanotubes on a flexible substrate such as graphite or Aluminum foil.

In some embodiments of the invention the substrate may comprise a carbon fibre mat. The diameter of the carbon fibre used may be controlled to control the adsorption surface area and the air flow resistance of the carbon fibre mat.

In the embodiment illustrated in FIG. 1 the substrate is provided in a plurality of layers which are positioned on top of each other. It is to be appreciated that in other embodiments of the invention the substrate may be provided in other configurations for example it maybe rolled into a tube shape or folded over on itself.

In some embodiments of the invention the material used as the substrate may impede the flow of air molecules. For example, where a metal foil such as aluminum foil is used the foil acts as a barrier to the moving air molecules. In such embodiments the substrate may be positioned so that the pressure wave created by diaphragm 7 is incident directly on the carbon nanohorn material 13 rather than the substrate.

In the third configuration 14C the carbon nanohorn material 13 is provided as a powder comprising carbon nanohorns. The powder comprising carbon nanohorns is positioned within the acoustic cavity 11. A seal 15 is provided to act as a barrier and prevent the powder comprising carbon nanohorns from leaking into the other parts of the apparatus 1. In particular the seal 15 acts as a barrier between the powdered comprising carbon nanohorns and the loudspeaker 5 and prevent the powdered from sticking to any charged parts of the loudspeaker 5.

In the embodiment of the invention illustrated in FIG. 1 three different types of configuration of carbon nanohorn material 13 are provided within a single apparatus. It is to be appreciated that in other embodiments of the invention only one or two of the different configurations may be provided within a single apparatus 1. Furthermore, in embodiments of the invention where the carbon nanohorn material 13 is adhered either to a substrate or to the walls of an acoustic cavity 11 then it might not be necessary to provide the seal 15 as there is no loose powder to leak into other components of the apparatus 1.

Figure 2:
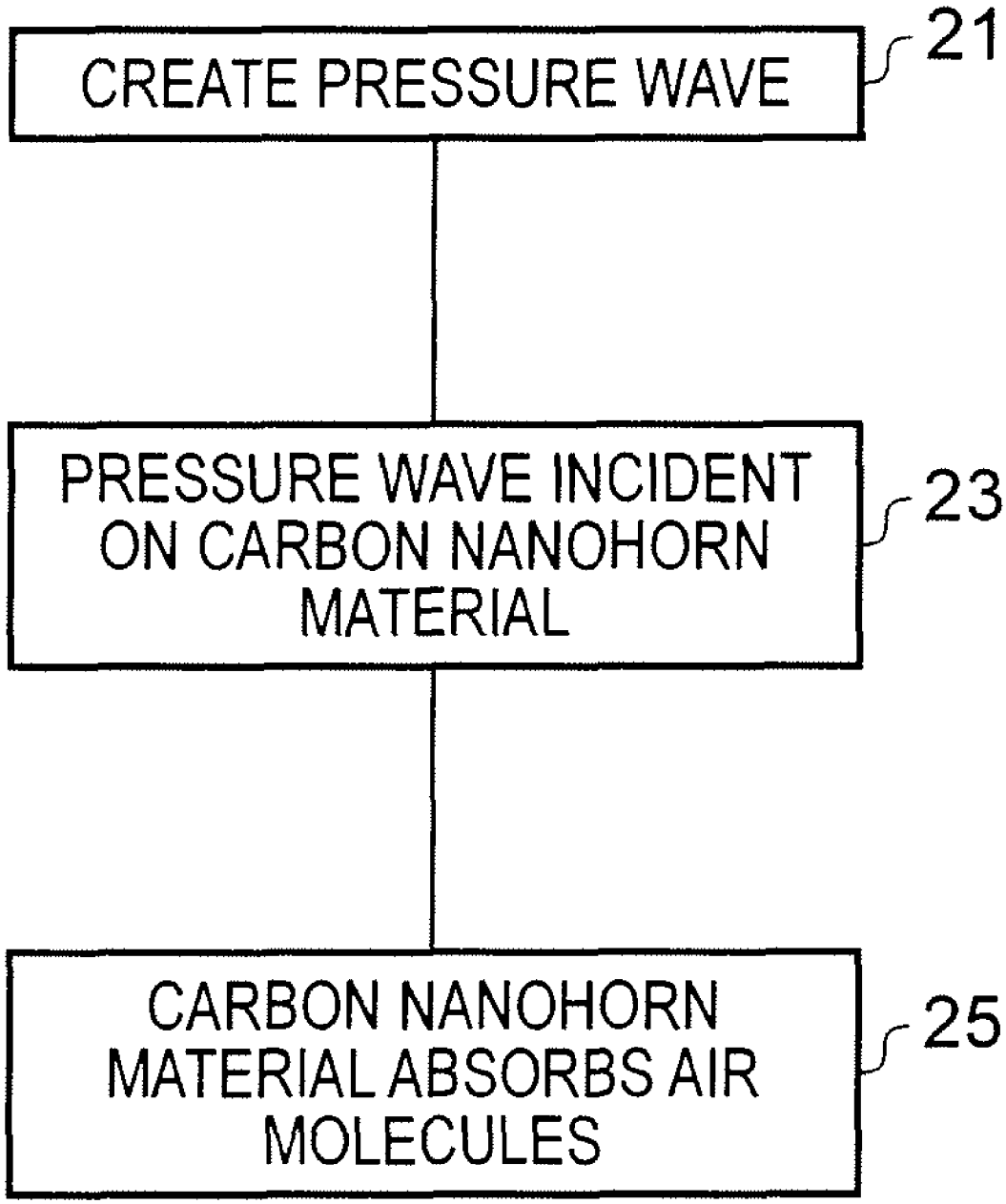
FIG. 2 is a block diagram illustrating blocks of a method of using the apparatus illustrated in FIG. 1.

FIG. 2 is a block diagram illustrating blocks of a method of using the apparatus 1 illustrated in FIG. 1.

At block 21 the loudspeaker creates an acoustic output signal. In the following explanation the driver 9 is moving inwards so as to increase the pressure in the acoustic cavity 11. As described above the acoustic output signal is produced by movement of the driver 9 and the diaphragm 7 in response to an electrical input signal. This creates a pressure wave both in front of the diaphragm 7 and behind the diaphragm 7 so that a pressure wave is created within the acoustic cavity 11. As the driver 9 is moving inward in this example the pressure wave increases the pressure within the acoustic cavity 11.

At block 23 the pressure wave created by the acoustic output signal is incident upon the carbon nanohorn material 13. As mentioned above the carbon nanohorn material 13 is positioned so that that it is exposed to the acoustic output signal created by the loudspeaker 5. That is, the pressure wave which is created by the loudspeaker 5 is incident on the carbon nanohorn material 13. This creates a variation in the pressure at the surface of the carbon nanohorn material 13.

As the driver 9 has moved inwards into the acoustic cavity 11 this creates an increase in pressure in the acoustic cavity. At block 25 the carbon nanohorn material 13 adsorbs air molecules in response to the increase in pressure at the surface of the carbon nanohorn material 13.

Figure 3:
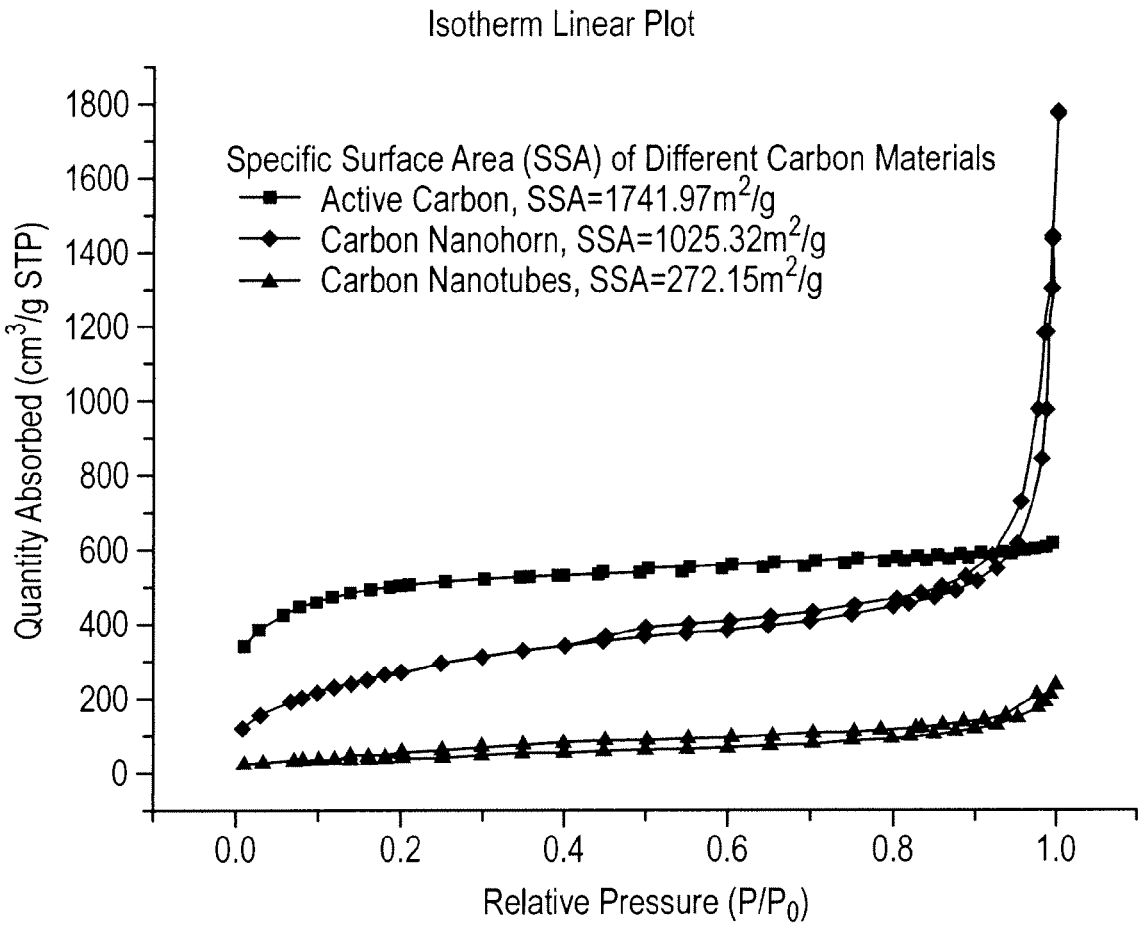
FIG. 3 is a plot of quantity of air adsorbed vs relative pressure.

Carbon nanohorns are very effective at adsorbing molecules such as nitrogen or oxygen in response to a small change in pressure. FIG. 3 illustrates a isotherm linear plot of quantity of nitrogen adsorbed vs relative pressure. The line comprising triangles corresponds to carbon nanotubes, the line comprising squares corresponds to active carbon and the line comprising circles corresponds to carbon nanohorns. It can be seen form this plot that carbon nanohorns are significantly more effective than either active carbon or carbon nanotubes for small changes in atmospheric pressure.

As the carbon nanohorn material 13 adsorbs air molecules this reduces the number of air molecules within the acoustic cavity 11. The reduction in the amount of gaseous molecules within the acoustic cavity 11 suppresses the increase in pressure caused by the movement of the driver 9. That is for a given movement inwards by the driver 9 there is a smaller increase in pressure within the acoustic cavity 11 than if the carbon nanohorn material 13 was not present. As the air within the acoustic cavity 11 acts as a spring, the suppression of the increase in pressure acts to reduce the stiffness of the spring and the resistance to the motion of the driver 9. This has the effect of lowering the resonant frequency of the loudspeaker 5 which improves the low frequency response of the loudspeaker 5.

Therefore embodiments of the invention provide the advantage that the use of the carbon nanohorn material 13 reduces the resonant frequency of the loudspeaker 5 and so improves the low frequency response of the loudspeaker. This increases the effective volume of the acoustic cavity 11. That is the carbon nanohorn material 13 enables the acoustic cavity 11 to produce the same frequency response as a larger acoustic cavity 11 without any carbon nanohorn material 13. This enables a smaller acoustic cavity 11 to be used in apparatus without reducing the quality of the low frequency response of the loudspeaker 5.

The dimensions of the acoustic cavity and the configuration of the carbon nanohorn material 13 may be selected to provide an improved frequency response below a specific frequency. For example it may improve the response in a frequency range between 800-1000 Hz.

Figure 4:
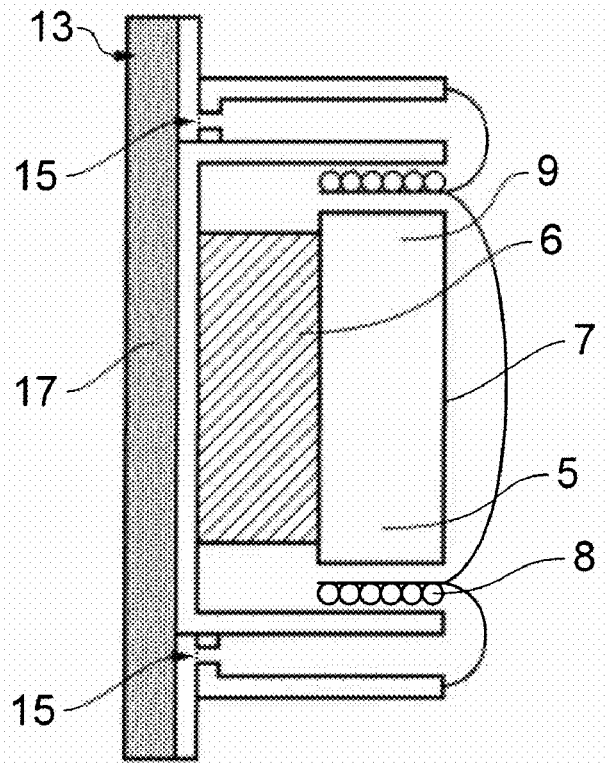
FIG. 4 schematically illustrates an apparatus according to another embodiment of the invention.

FIG. 4 schematically illustrates a cross section of an apparatus 1 according to another embodiment of the invention. The apparatus 1 illustrated in FIG. 4 is similar to the apparatus illustrated in FIG. 1 in that it comprises a loudspeaker 5, an acoustic cavity 11 and carbon nanohorn material 13.

The loudspeaker 5 comprises a driver 9 and a diaphragm 7 as in the previous embodiment. In FIG. 4 the driver 9 comprises a magnet 6 and a coil 8. The electrical input signal is provided to the coil 8 and creates a current within the coil 8 generates an electromagnetic field. The magnet 6 will either be pulled towards the coil 8 or pushed away from the coil 8 depending on the direction of the current in the coil 8. This moves the driver 9 which then moves the diaphragm 7 to create the acoustic output signal.

The apparatus 1 also comprises an acoustic cavity 11. In the embodiment illustrated in FIG. 4 the acoustic cavity 11 is provided directly behind the driver 9.

The acoustic cavity 11 comprises carbon nanohorn material 13. The carbon nanohorn material 13 is provided as a powder in the embodiment illustrated in FIG. 4. It is to be appreciated that the carbon nanohorn material 13 may be provided in any suitable configuration as described above.

As the carbon nanohorn material 13 is provided as a powder a seal 15 is provided which prevents leakage of the carbon nanohorn material 13. The seal acts as a barrier to the carbon nanohorn material 13 but enables the pressure wave to pass through.

The apparatus 1 illustrated in FIG. 4 works in the same way as the apparatus 1 illustrated in FIG. 1 as described above with reference to FIG. 2.

Figure 5:
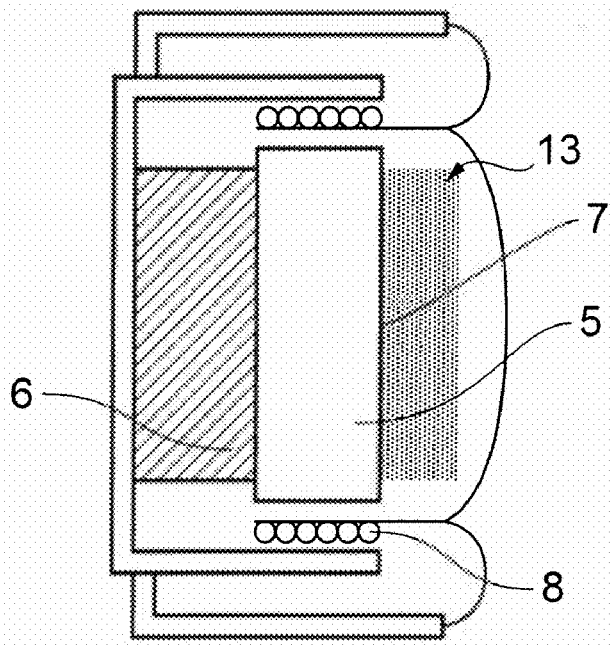
FIG. 5 schematically illustrates an apparatus according to a further embodiment of the invention.

FIG. 5 schematically illustrates a cross section of an apparatus according to a further embodiment of the invention. The apparatus 1 as illustrated in FIG. 5 comprises a loudspeaker as illustrated in FIG. 4. However, the apparatus in FIG. 5 does not comprise an acoustic cavity. In FIG. 5 the carbon nanohorn material 13 is provided adjacent to the diaphragm 7. When the diaphragm 7 moves to create an increase in pressure the carbon nanohorn material 13 adsorbs air molecules and so suppresses the increase in pressure. Similarly when the diaphragm 7 moves to create a decrease in pressure the carbon nanohorn material 13 desorbs the adsorbed material and acts to suppress the decrease in pressure. Therefore the carbon nanohorn material 13 decreases the resistance to the motion of the diaphragm 7 and improves the frequency response of the loudspeaker 5.

The blocks illustrated in FIG. 2 may represent steps in a method. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, in the embodiments of the invention described above an electrodynamic loudspeaker is used, it is to be appreciated that other types of loudspeaker may be used, for example, an electrostatic loudspeaker.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

Also in some embodiments of the invention the carbon nanohorn material may be mixed with other material. For example in some embodiments of the invention the carbon nanohorn material may be mixed with carbon nano-onions. Carbon nano-onions comprise carbon spheres of increasing diameter layered on top of each other. The size of the carbon nano-onions may range from 5 to 15 mm. The size of the carbon nano-onions may enable the nano-onions to fit into interstitial positions within a carbon nanohorn aggregate. This may increase the adsorption of the nanohorn material and reduce the resonant frequency of the loudspeaker.

We claim:

1. An apparatus comprising:

a loudspeaker configured to convert an electrical input signal into an acoustic output signal; and a carbon nanohorn mixture, wherein the carbon nanohorn mixture comprises carbon nanohorn material mixed with another material, wherein the carbon nanohorn mixture is positioned so as to be exposed to the acoustic output signal, wherein the carbon nanohorn mixture is bound to a substrate, and wherein the substrate comprises a carbon nanotube mat.

2. An apparatus as claimed in claim 1 wherein the carbon nanohorn material adsorbs air molecules in response to an increase in pressure caused by the acoustic output signal and so reduces the resonant frequency of the loudspeaker.

3. An apparatus as claimed in claim 1 wherein the loudspeaker is positioned within an acoustic cavity and the carbon nanohorn material is positioned within the acoustic cavity.

4. An apparatus as claimed in claim 3 wherein the acoustic cavity comprises walls configured to enable the carbon nanohorn material to be adhered to the apparatus.

5. An apparatus as claimed in claim 1 wherein the carbon nanohorn material comprises a powder.

6. An apparatus as claimed in claim 5 wherein the apparatus comprises a seal configured to prevent leakage of the carbon nanohorn material.

7. An apparatus as claimed in claim 1 wherein the carbon nanohorn material is mixed with a polymer to enable the carbon nanohorn material to be adhered to the apparatus.

8. An apparatus as claimed in claim 1 wherein the substrate is bent to enable the substrate to fit within the apparatus.

9. An apparatus as claimed in claim 1 wherein the substrate comprises paper or aluminium foil.

10. An apparatus as claimed in claim 1 wherein the carbon nanohorn mixture comprises carbon nanohorn material mixed with carbon nano-onions.

11. A method comprising:

configuring a loudspeaker to convert an electrical input signal into an acoustic output signal;

positioning a carbon nanohorn mixture so as to be exposed to the acoustic output signal, wherein the carbon nanohorn mixture comprises carbon nanohorn material mixed with another material; and binding the carbon nanohorn mixture to a substrate, wherein the substrate comprises a carbon nanotube mat.

12. A method as claimed in claim 11 wherein the carbon nanohorn material is positioned so that the carbon nanohorn material adsorbs air molecules in response to an increase in pressure caused by the acoustic output signal and so reduces the resonant frequency of the loudspeaker.

13. A method as claimed in claim 11 comprising positioning the loudspeaker within an acoustic cavity and positioning the carbon nanohorn material within the acoustic cavity and adhering the carbon nanohorn material to walls of the acoustic cavity.

14. A method as claimed in claim 11 wherein the carbon nanohorn material comprises a powder.

15. A method as claimed in claim 14 comprising sealing the carbon nanohorn material in position to prevent leakage of the carbon nanohorn material.

16. A method as claimed in claim 11 comprising mixing the carbon nanohorn material with a polymer to enable the carbon nanohorn material to be adhered in position.

17. A method as claimed in claim 11 comprising bending the substrate to enable the substrate to fit within an apparatus.

18. A method as claimed in claim 11 wherein the substrate comprises paper or aluminium foil.

* * * * *